US007333625B2

(12) United States Patent
Jacobs et al.

(10) Patent No.: US 7,333,625 B2
(45) Date of Patent: Feb. 19, 2008

(54) COLLAPSIBLE ELECTRO-ACOUSTIC TRANSDUCER SYSTEM

(75) Inventors: David Jacobs, Palos Verdes Estates, CA (US); Shawn Pasternak, Long Beach, CA (US)

(73) Assignee: Anchor Audio, Inc., Torrance, CA (US)

( * ) Notice: Subject to any disclaimer, the term of this patent is extended or adjusted under 35 U.S.C. 154(b) by 276 days.

(21) Appl. No.: 11/099,345

(22) Filed: Apr. 5, 2005

(65) Prior Publication Data

US 2006/0222190 A1 Oct. 5, 2006

(51) Int. Cl.
*H04R 1/02* (2006.01)

(52) U.S. Cl. ..... 381/345; 381/387

(58) Field of Classification Search ..... 181/198, 181/199; 381/345, 386, 387, 388, 395
See application file for complete search history.

(56) References Cited

U.S. PATENT DOCUMENTS 5,590,214 A * 12/1996 Nakamura ..... 381/182
7,016,513 B2 * 3/2006 Noselli ..... 381/386

* cited by examiner

*Primary Examiner*—Brian Ensey
(74) *Attorney, Agent, or Firm*—The Eclipse Group LLP

(57) ABSTRACT

A collapsible electro-acoustic transducer system ("CETS") is described. The CETS system may include a base housing with at least one electro-acoustic transducer, where the base housing includes a base housing top and a base housing bottom, and a movable housing having at least one electro-acoustic transducer, where the movable housing is movably attached to the base housing. The CETS may also include an attaching element movably attaching the movable housing to the base housing, where the movable housing is configured to collapse within the base housing.

21 Claims, 19 Drawing Sheets

COLLAPSIBLE ELECTRO-ACOUSTIC TRANSDUCER SYSTEM

BACKGROUND OF THE INVENTION

1. Field of Invention

The invention relates to electro-acoustical audio transducer systems, and in particular, to portable public address systems using multiple loudspeakers.

2. Related Art

A sound system is a system for amplifying, reproducing, and sometimes recording audio. The configuration of such a sound system depends on its intended application. As an example, a public address system ("PA system") typically includes microphones, an amplifier, loudspeakers, and controls to mix the signals coming from the microphones or other input sources, such as phonograph turntables, tape recorders, and CD players. PA systems may be as simple as a small, portable battery-powered unit with one or more microphones and one or more loudspeakers for use in a small auditorium or assembly hall. Other larger PA systems may have dozens of speakers, including the subwoofers, woofers, mid-range speakers, and tweeters necessary to cover a wide range of frequencies, and that may require large amounts of power to create audio for large outdoor public arenas and stadiums. Such PA systems may contain mixing consoles that enable sound engineers, or disk jockeys, to adjust the volume of each microphone or other input source individually. The PA system may also contain an equalizer that allows adjustment of different frequency ranges within an audio signal. Sound effects, such as reverb, digital echo, or digital time delay, may be added to the audio by components that might be included in such a PA system.

Unfortunately, these types of PA systems are typically bulky and complex having numerous components, loudspeakers and wires that need to be connected and disconnected every time that these types of PA systems are utilized. Therefore, there is a need for a portable self-contained audio system that may be moved into place quickly and efficiently as a single unit and that may also be easily set up and then disassembled, stored and removed after its use. Additionally, there is also a need for this portable self-contained audio system audio to allow the incorporation of multiple components such as loudspeakers, microphones and power sources that may be varied in response to the needs of the user.

SUMMARY OF THE INVENTION

A collapsible electro-acoustic transducer system ("CETS") is described. The CETS system may include a base housing with at least one electro-acoustic transducer, where the base housing includes a base housing top and a base housing bottom, and a movable housing having at least one electro-acoustic transducer, where the movable housing is movably attached to the base housing. The CETS may also include an attaching element movably attaching the movable housing to the base housing, where the movable housing is configured to collapse within the base housing.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. In the figures, like reference numerals designate corresponding parts throughout the different views.

DETAILED DESCRIPTION

In the following description of the preferred embodiment, reference is made to the accompanying drawings that form a part hereof, and in which is shown by way of illustration a specific embodiment in which the invention may be practiced. It is to be understood that other embodiments may be utilized and structural changes may be made without departing from the scope of the present invention.

Figure 1A:
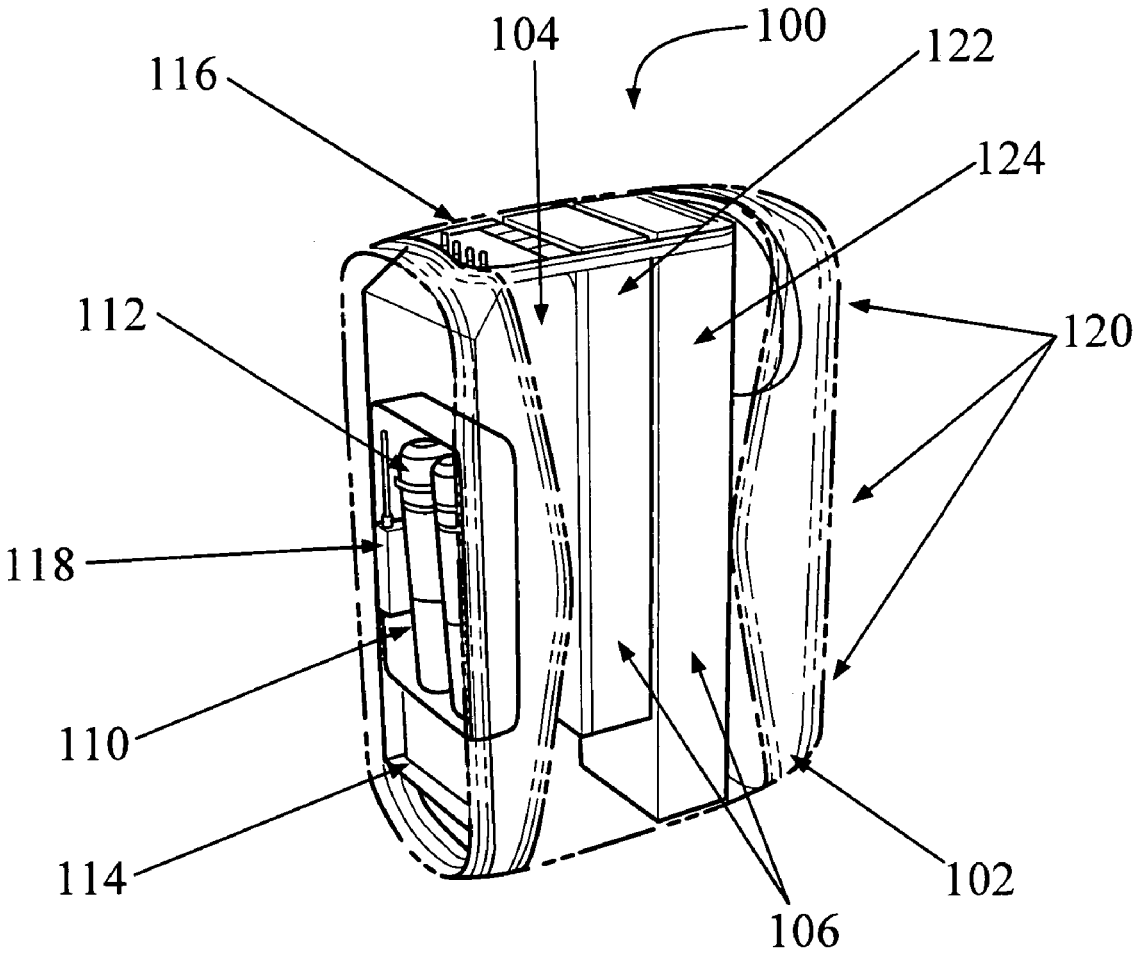
FIG. 1A is a perspective side-view of an example of an implementation of a collapsible electro-acoustic transducer system ("CETS") in a collapsed state in accordance with the present invention, where a movable housing is stored completely within a base housing.

In FIG. 1A, a perspective side-view of an example of an implementation of a collapsible electro-acoustic transducer system ("CETS") 100 in a collapsed state in accordance with the present invention is shown. The CETS 100 may include an external housing 102, a base housing 104, and a movable housing 106. The movable housing 106 is shown stored completely within a base housing 104. As an example, when not in use and stored, the movable housing 106 is collapsed and telescoped into the base housing 104. Both the base housing 104 and the movable housing 106 are then enclosed within the external housing 102. In some embodiments, the external housing 102 and the base housing 104 may comprise a single, integrated unit. In others, the external housing 102 and the base housing 104 may comprise separate units that are connected or attached, with the base housing 104 capable of being removed from and reinserted into the external housing 102. The base housing 104 may include a base housing top (not shown) and a base housing bottom (not shown). The external housing 102 and base housing 104 may be constructed of various materials, e.g., stainless steel, injection molded polypropylene or ABS, or formed composite/sheet material, based on considerations of weight, durability, aesthetics, etc.

Within the base housing 104 there may be a storage area 110 in which may be stored peripheral devices 112 such as, for example, microphones, power cords (not shown) and other audio accessories. Also within the base housing 104 there may a control panel 114, a DVD/CD player 116 or other similar audio devices, and power connectors or batteries 118. As an example, the base housing 104 may also include a plurality of electro-acoustic transducers 120 arranged as an array of loudspeakers. Generally, these electro-acoustic transducers 120 may be loudspeakers such as, for example, low-frequency transducers generally known as woofers or subwoofers.

Figure 1B:
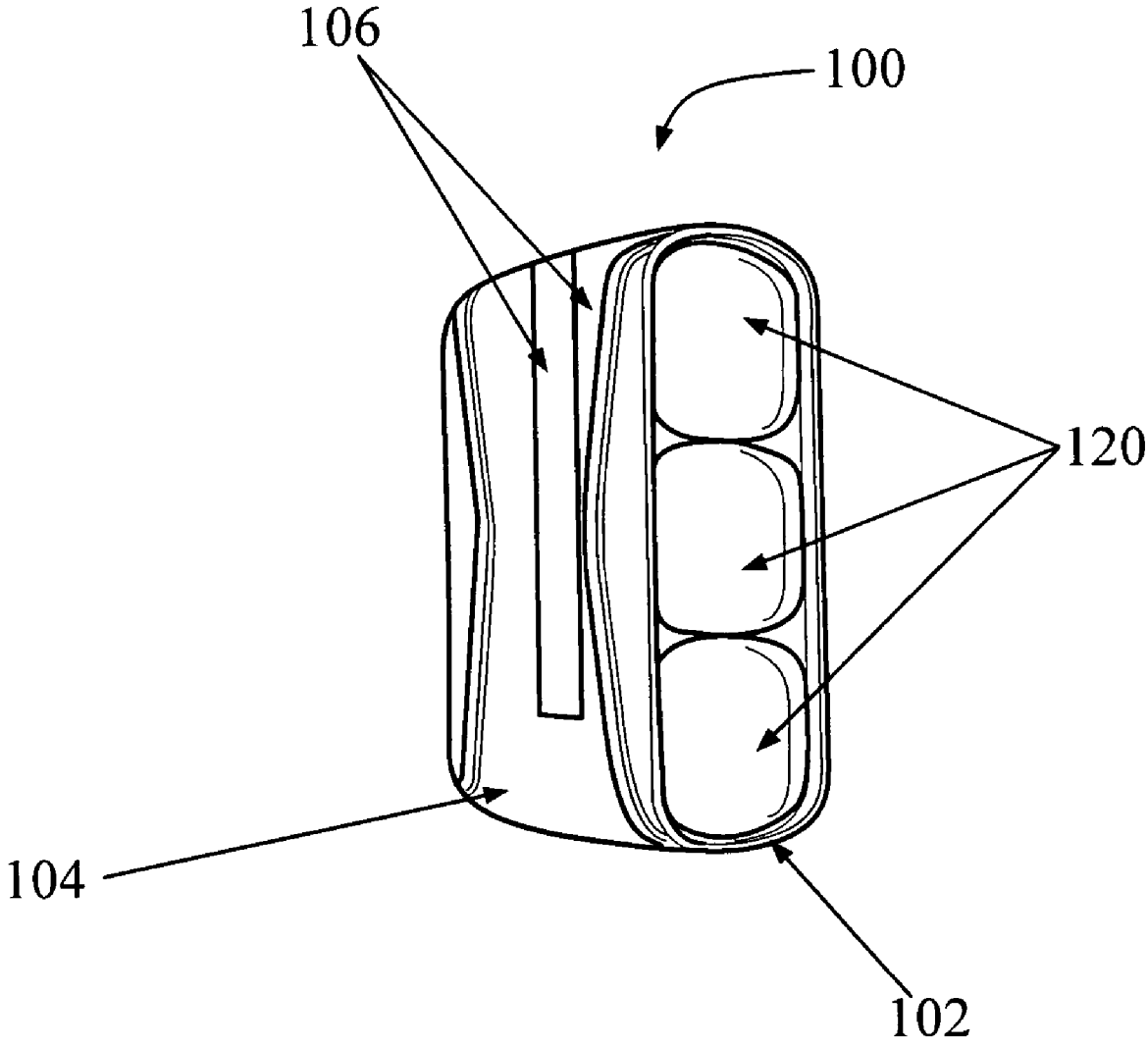
FIG. 1B is perspective front-view of the example of the implementation of the CETS shown in FIG. 1A, showing a plurality of transducers within the CETS.

In this example implementation, the movable housing 106 may include a first array element 122 and a second array element 124. The first array element 122 and the second array element 124 may each contain one or more transducers (not shown). Generally, these transducers may include mid-range loudspeakers (known as mid-ranges) and/or high-frequency loudspeakers (known as tweeters), although any type of loudspeaker may be used. In FIG. 1B, a perspective front-view of the example of the implementation of the CETS shown in FIG. 1A is shown. FIG. 1B shows the plurality of transducers 120 within the CETS 100.

Figure 2:
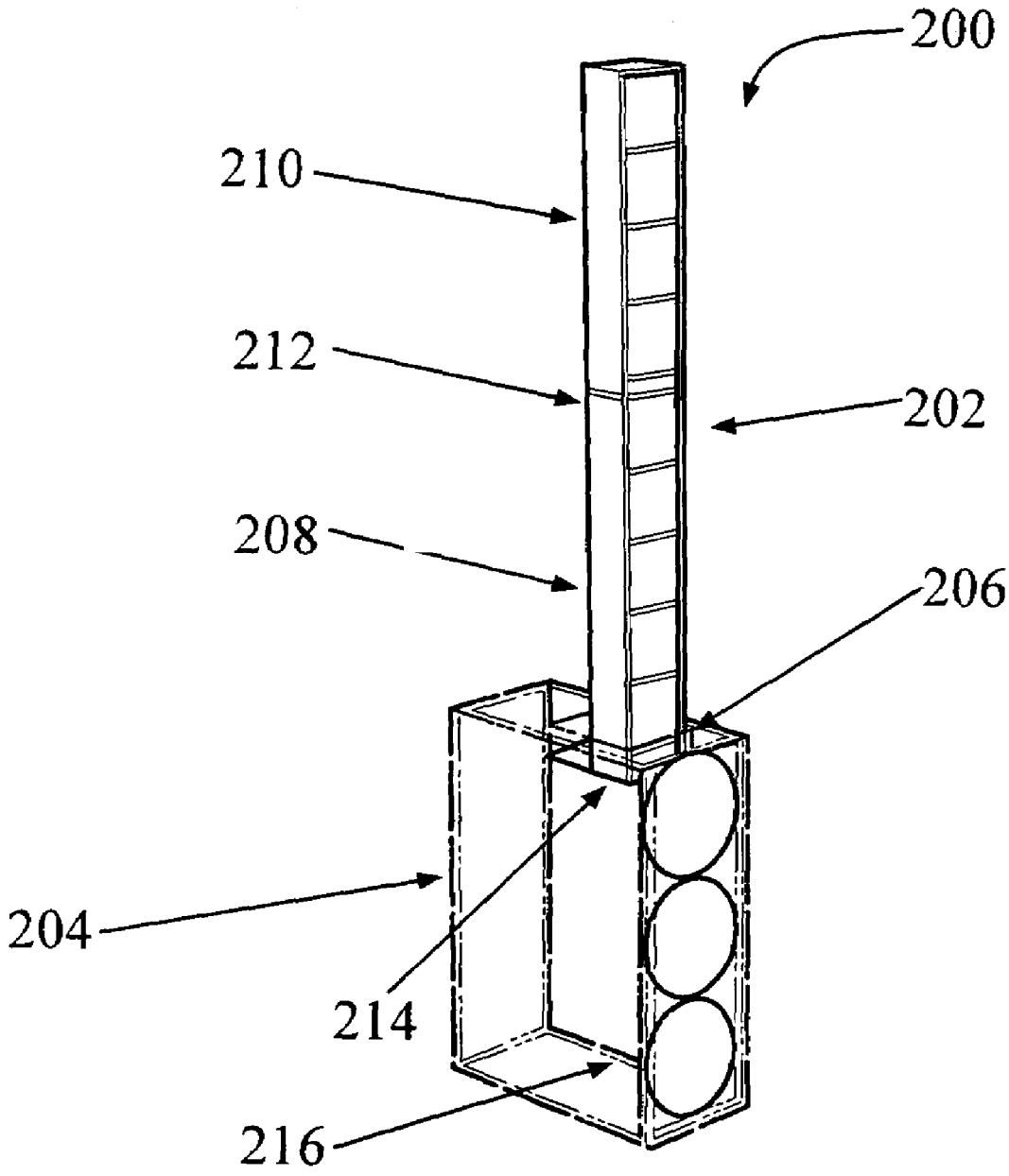
FIG. 2 is a perspective side-view of an example of an implementation of the CETS shown in FIGS. 1A and 1B in an extended state in accordance with the present invention, where the movable housing is extended externally to the base housing.

In FIG. 2, a perspective side-view of an example of an implementation of the CETS 200 shown in FIGS. 1A and 1B in an extended state is shown in accordance with the present invention, where the movable housing 202 is extended externally to the base housing 204 and the movable housing 202 is attached to the base housing 204 with a first attachment element 206. The movable housing 202 may include a first array element 208 and a second array element 210 attached together by a second attachment element 212.

Attached to the bottom of first array element 208 is a first array base plate 214. The first array base plate 214 rests on the base housing bottom 216 of the base housing 204 when the movable housing 202 is stored within the base housing 204. The second attachment element 212 may be a rear hinge and the first attachment element 206 may be a combination of slider rails (not shown) for guiding the movable housing 202 into the base housing 204.

Figure 3:
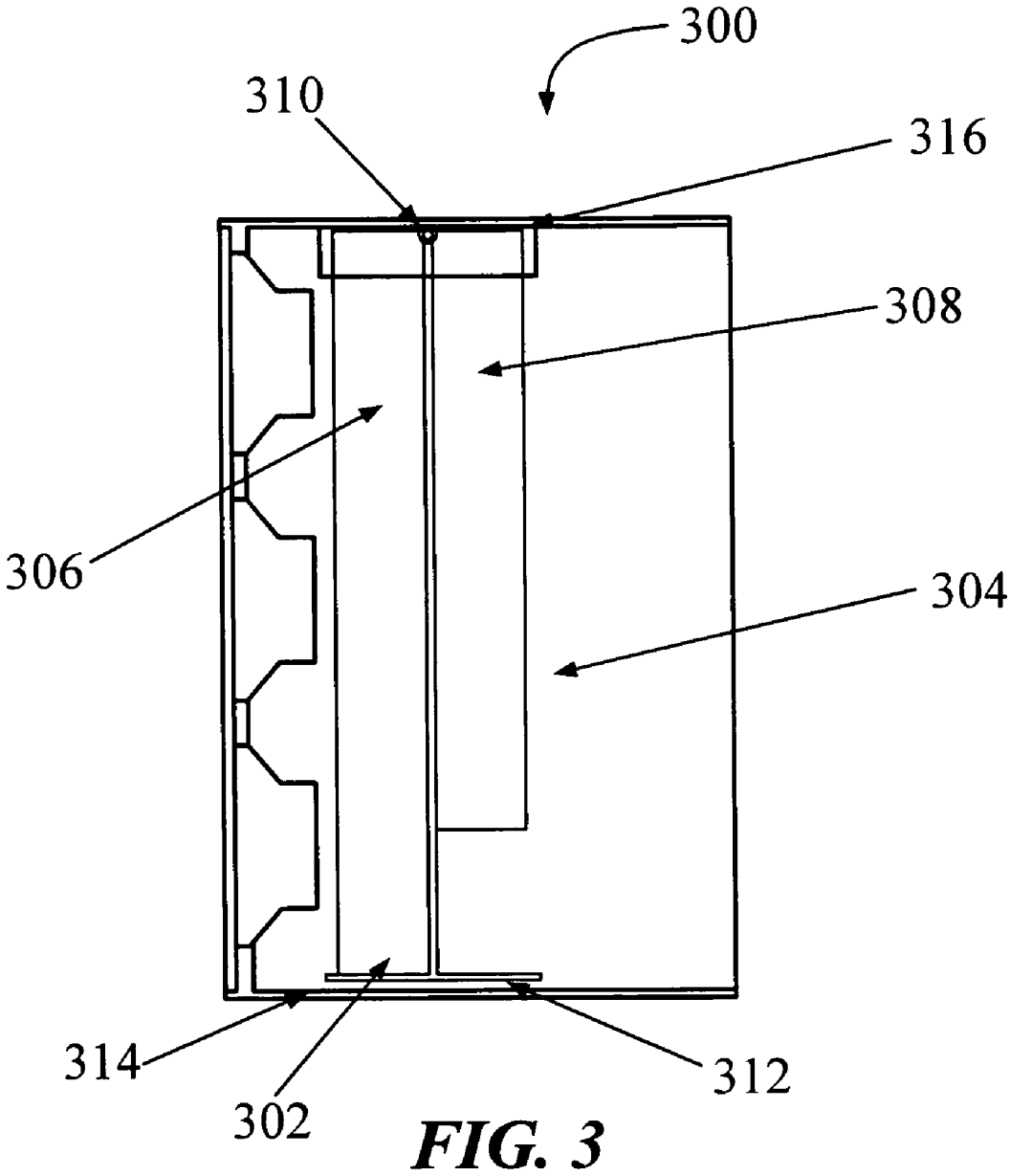
FIG. 3 is a cross-sectional side-view of an example of an implementation of the CETS shown in FIGS. 1A and 1B in a collapsed state in accordance with the present invention, where the movable housing is stored within the base housing.

Similarly, in FIG. 3, a cross-sectional side-view of an example of an implementation of the CETS 300 is shown in a collapsed state in accordance with the present invention, where the movable housing 302 is stored within the base housing 304. Again, the movable housing 302 may include a first array element 306 and a second array element 308 attached together by a second attachment element 310.

Attached to the bottom of the first array element 306 is a first array base plate 312. The first array base plate 312 rests on the base housing bottom 314 of the base housing 304 when the movable housing 302 is stored within the base housing 304. The second attachment element 310 may be a rear hinge and the first attachment element 316 may be a combination of slider rails (not shown) for guiding the movable housing 302 into the base housing 304.

Figure 4:
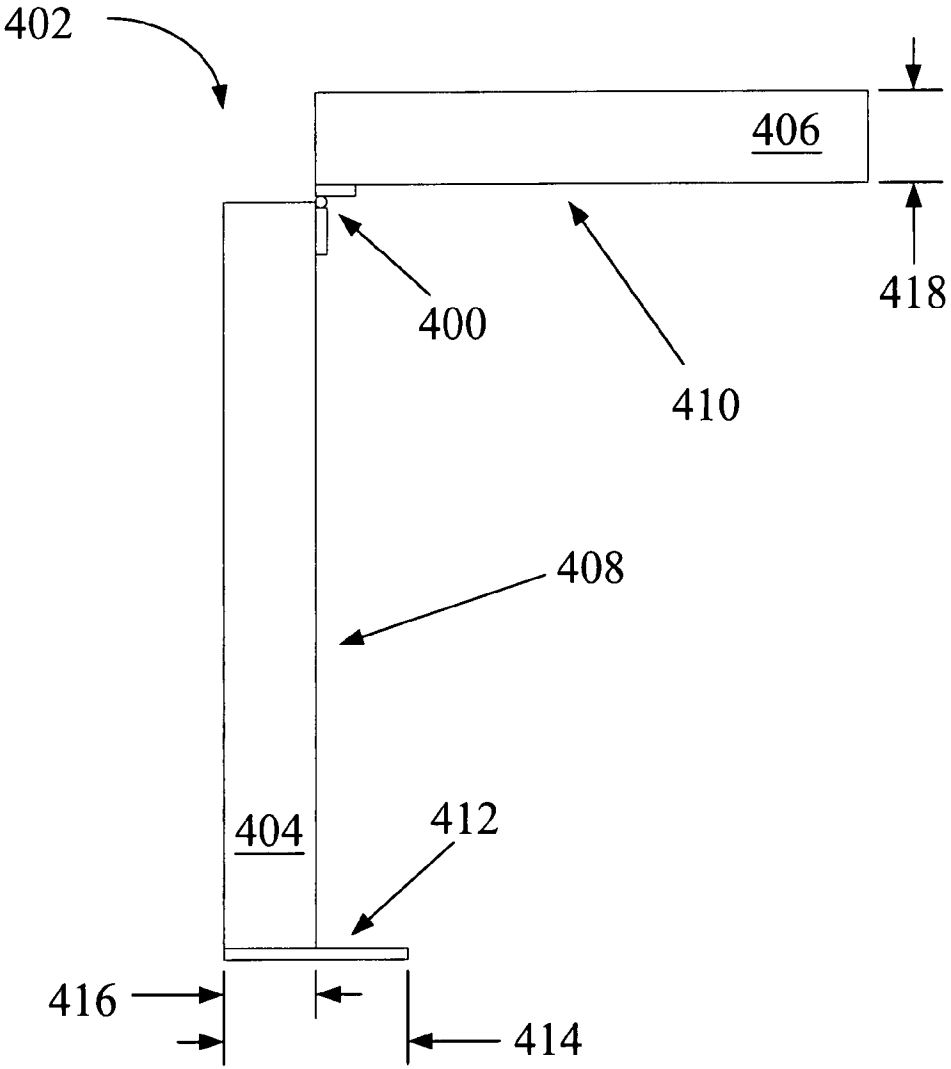
FIG. 4 is a cross-sectional side-view of an example of an implementation of an attaching element within the movable housing in accordance with the present invention.

In FIG. 4, a cross-sectional side-view of an example of an implementation of a second attaching element 400 within the movable housing 402 is shown in accordance with the present invention. The movable housing 402 includes the first array element 404 and the second array element 406 attached together by the second attachment element 400. The first array element 404 may include a first plurality of transducers 408 and the second array element 406 may include a second plurality of transducers 410. The first and second pluralities of transducers 408 and 410 may be a combination of loudspeakers such as midrange and/or tweeters type loudspeakers.

Attached to the bottom of the first array element 404 is a first array base plate 412. The first array base plate 412 rests on the base housing bottom (not shown) of the base housing (not shown) when the movable housing 402 is stored within the base housing. The second attachment element 400 may be a front hinge or other type of attaching device capable of folding the second array element 406 on to the first array element 404 (i.e., the second array element 406 on to the first array element 404 may be positioned adjacently such that the hinge element folds the second array element such that the first plurality of transducers 408 and the second plurality of transducers 410 are directed in the same direction). The first array base plate 412 may have a base plate length 414 long enough to cover the first width 416 of the first array element 404 and the second width 418 of the second array element 406.

Figure 5:
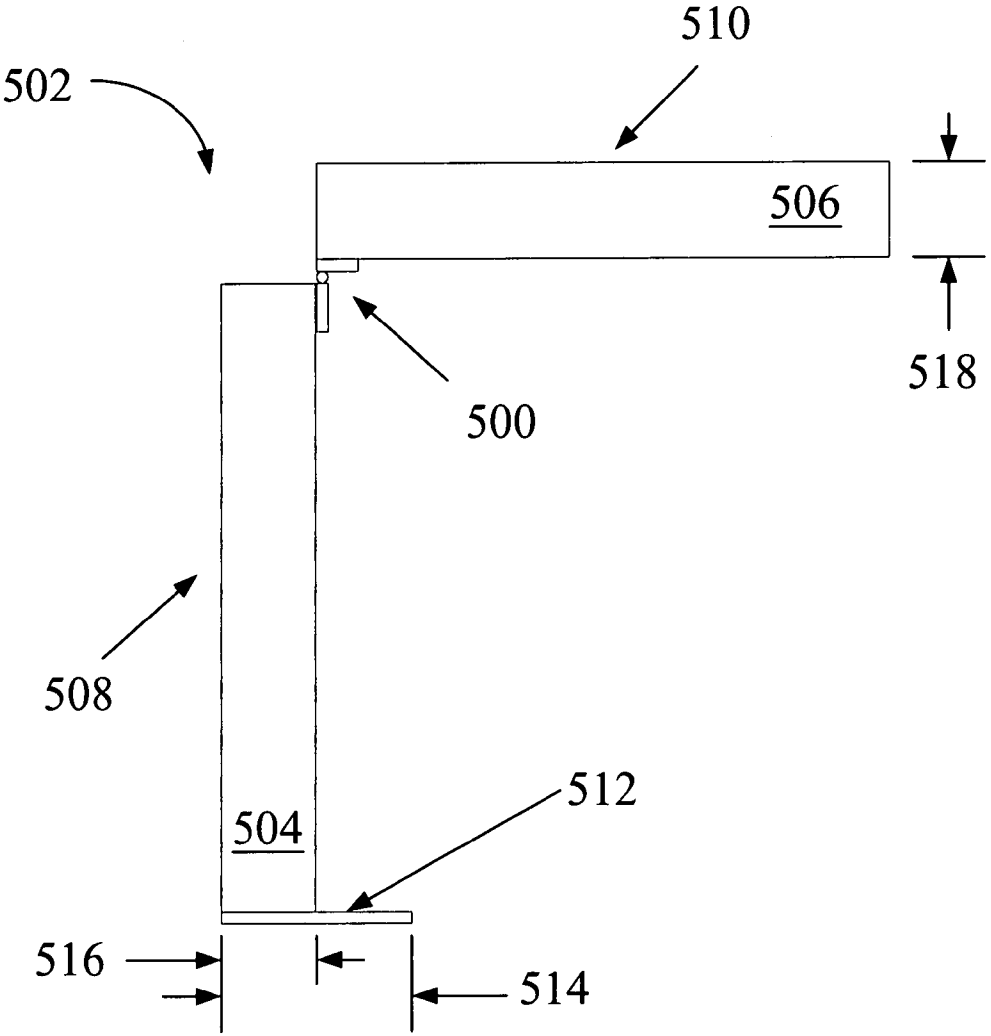
FIG. 5 is cross-sectional side view of an example of another implementation of an attaching element within the movable housing in accordance with the present invention.

Similarly, in FIG. 5, a cross-sectional side view of an example of another implementation of a second attaching element 500 within the movable housing 502 is shown in accordance with the present invention. Similar to FIG. 4, the movable housing 502 includes the first array element 504 and the second array element 506 attached together by the second attachment element 500. The first array element 504 may include a first plurality of transducers 508 and the second array element 506 may include a second plurality of transducers 510. The first and second pluralities of transducers 508 and 510 may be a combination of loudspeakers such as midrange and/or tweeters type loudspeakers.

Attached to the bottom of the first array element 504 is a first array base plate 512. The first array base plate 512 rests on the base housing bottom (not shown) of the base housing (not shown) when the movable housing 502 is stored within the base housing. Unlike FIG. 4, in FIG. 5, the second attachment element 500 may be a rear hinge or other type of attaching device capable of folding the second array element 506 on to the first array element 504 from the back of the movable housing 502 (i.e., the second array element 506 on to the first array element 504 may be positioned adjacently such that the hinge element folds the second array element such that the first plurality of transducers 508 and the second plurality of transducers 510 are directed in the same direction). Again, the first array base plate 512 may have a base plate length 514 long enough to cover the first width 516 of the first array element 504 and the second width 518 of the second array element 506.

Figure 6A:
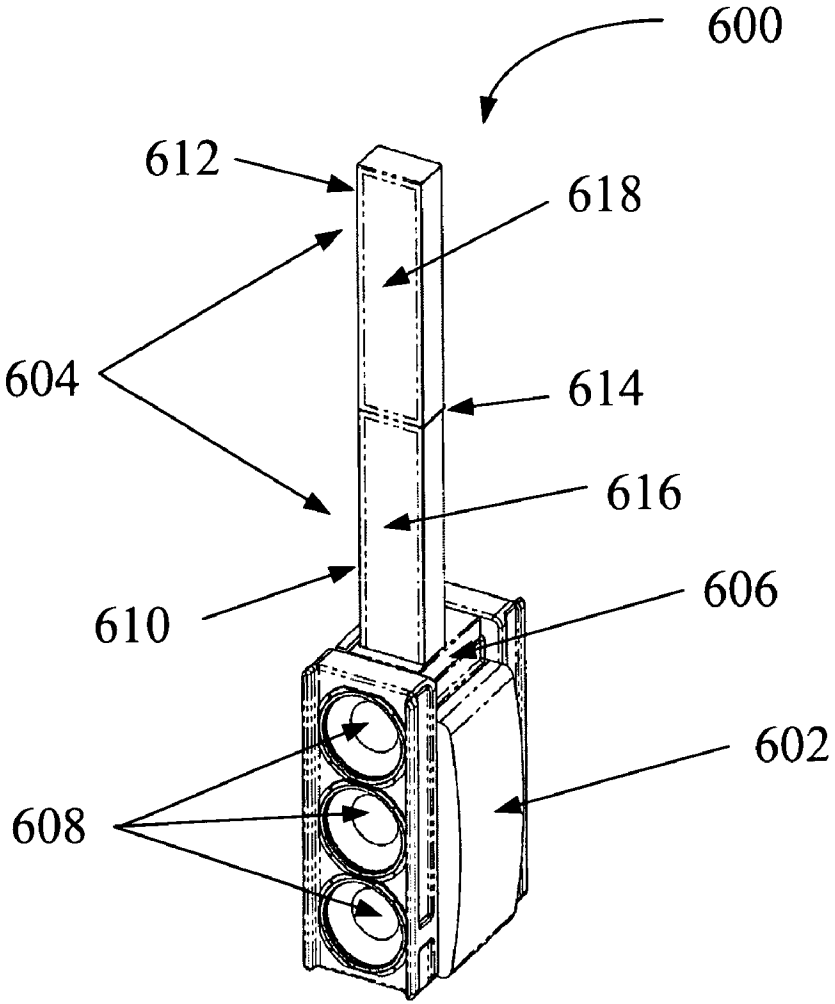
FIG. 6A is a perspective front-view of an example of an implementation of the CETS shown in FIGS. 1A and 1B in a fully extended state in accordance with the present invention.

In FIG. 6A, a perspective front-view of an example of an implementation of the CETS 600 is shown in a fully extended state in accordance with the present invention. Again, the CETS 600 may include a base housing 602 and a movable housing 604 attached together by a first attaching element 606. The base housing 602 may include a plurality of electro-acoustic transducers 608 arranged as an array of loudspeakers and the movable housing 604 may include a first array element 610 and a second array element 612 attached together by a second attachment element 614. The first array element 610 may include a first plurality of transducers 616 and the second array element 612 may include a second plurality of transducers 618. In this example, the CETS 600 is in a fully extended state because the movable housing 604 is fully extended external to the base housing 602.

Figure 6B:
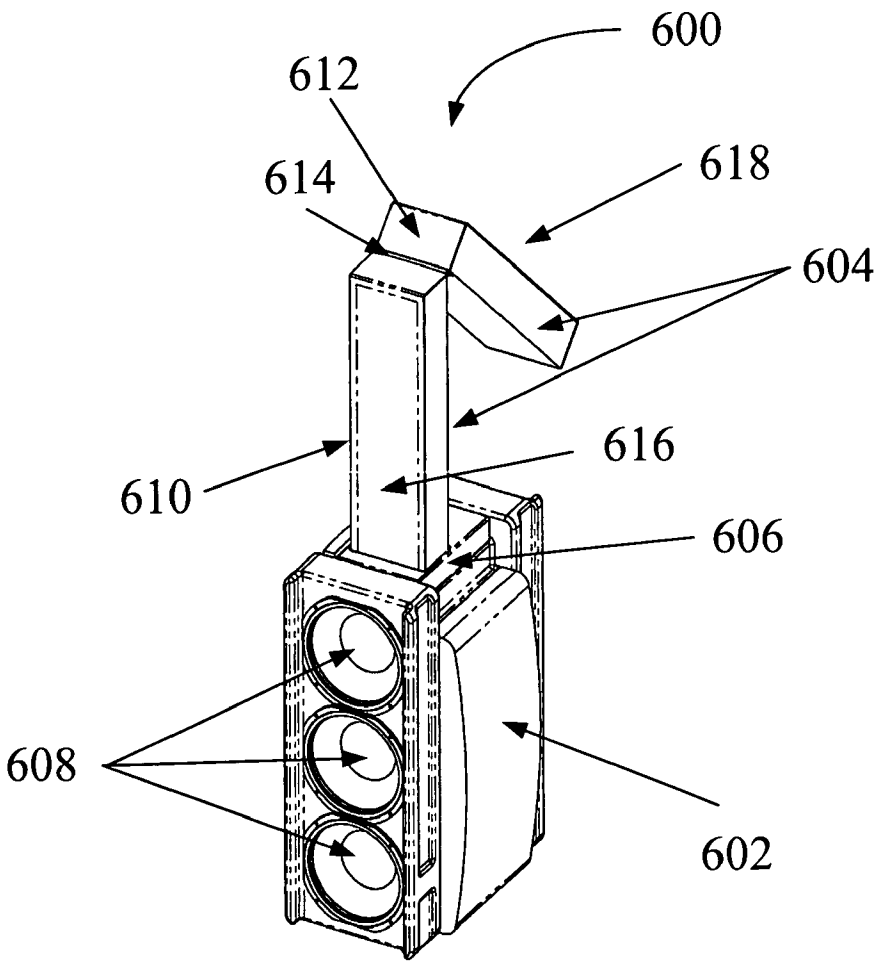
FIG. 6B is a perspective front-view of an example of an implementation of the CETS shown in FIG. 6A in a partially collapsed extended state in accordance with the present invention.
Figure 6C:
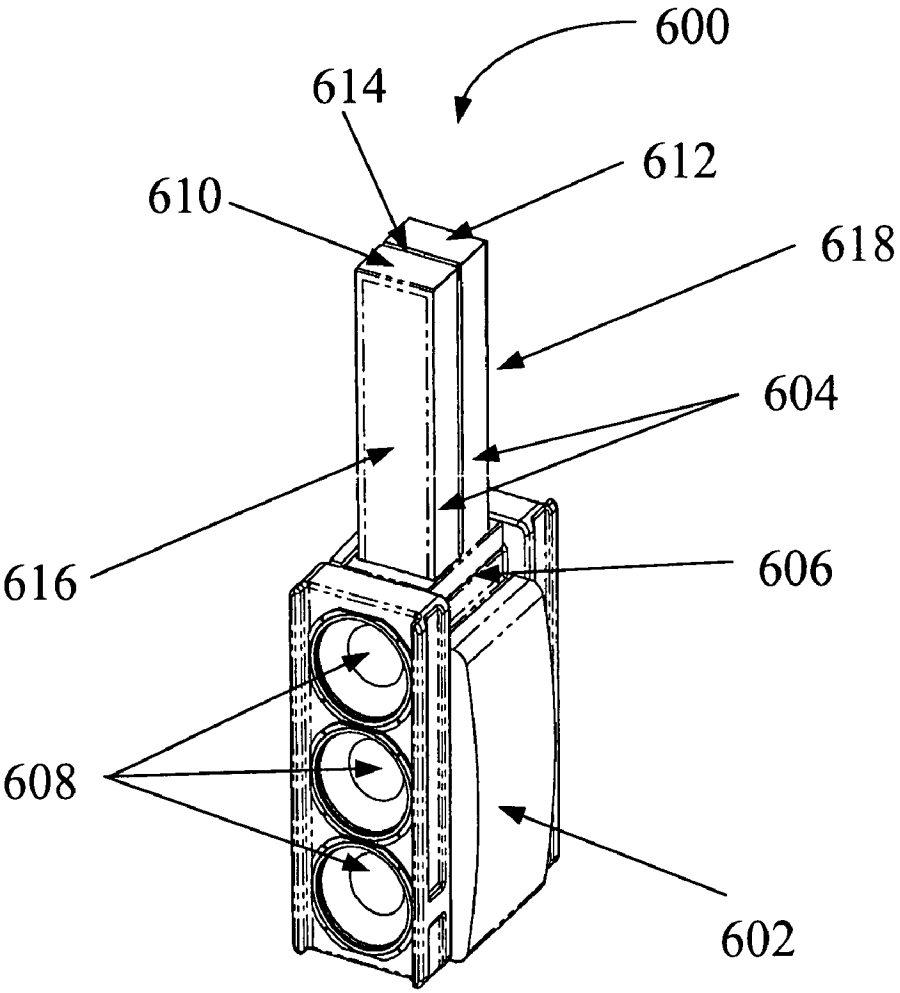
FIG. 6C is a perspective front-view of an example of an implementation of the CETS shown in FIGS. 6A and 6B in a folded extended state in accordance with the present invention.
Figure 6D:
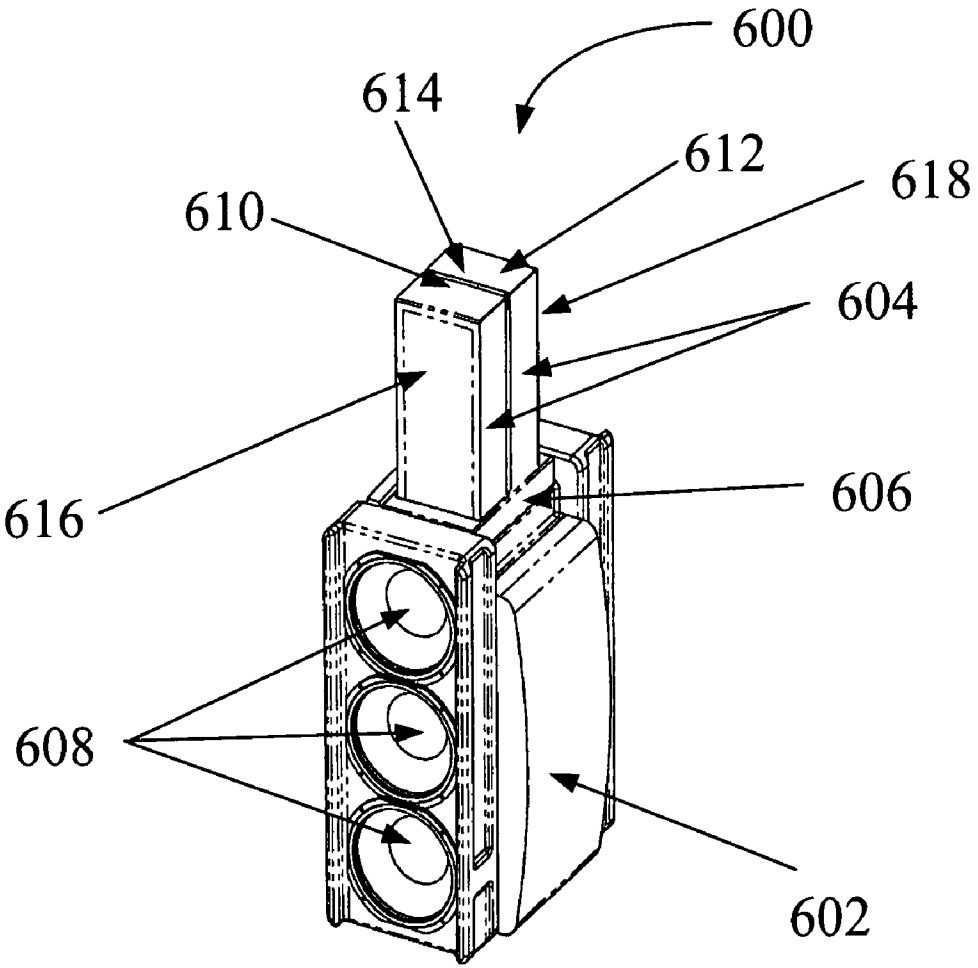
FIG. 6D is a perspective front-view of an example of an implementation of the CETS shown in FIGS. 6A, 6B and 6C in a folded extended state where the movable housing is slid into the base housing in a partially collapsed state in accordance with the present invention.

Similarly, in FIG. 6B, a perspective front-view of the example of the implementation of the CETS 600 is shown in a partially collapsed extended state in accordance with the present invention. In this example, the CETS 600 is in a partially collapsed extended state because the movable housing 604 is neither fully extended externally nor folded. In FIG. 6C, a perspective front-view of the example of the implementation of the CETS 600 is shown in a folded extended state. In this example, the CETS 600 is in a folded extended state because the movable housing 604 is folded externally to the base housing 602. Similarly, in FIG. 6D, a perspective front-view of the example of the implementation of the CETS 600 is shown in a folded partially collapsed state because the movable housing 604 is partially inserted within the base housing 602.

Figure 7A:
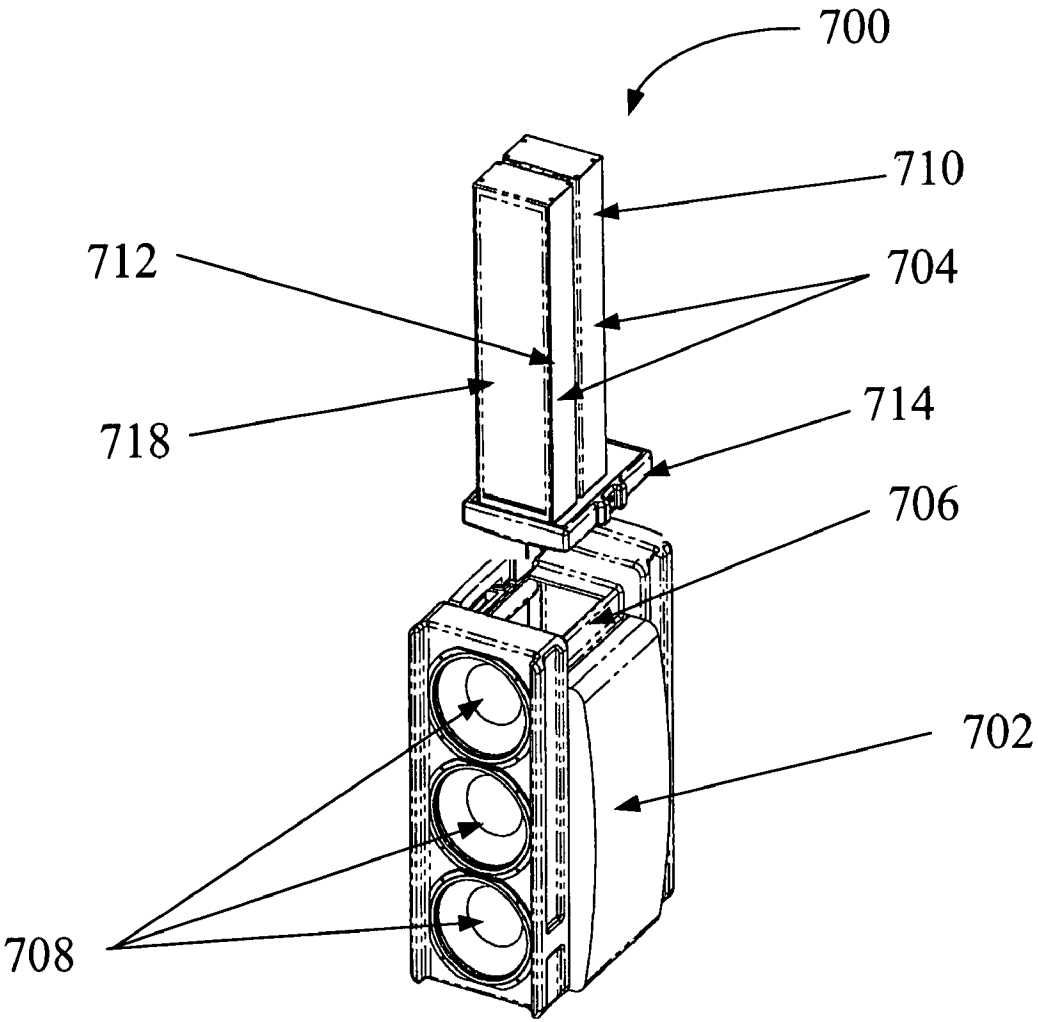
FIG. 7A is a perspective front-view of an example of another implementation of the CETS shown in FIGS. 1A and 1B in a folded extended state where the movable housing is detached from the base housing in accordance with the present invention.

In FIG. 7A, a perspective front-view of an example of another implementation of the CETS 700 is shown in a folded extended state in accordance with the present invention. The CETS 700 may include a base housing 702 and a movable housing 704 attached together by a first attaching element 706. The base housing 702 may include a plurality of electro-acoustic transducers 708 arranged as an array of loudspeakers and the movable housing 704 may include a first array element 710 and a second array element 712 attached together by a second attachment element 714. The first array element 710 may include a first plurality of transducers 716 and the second array element 712 may include a second plurality of transducers 718. In this example, the CETS 700 is in a folded extended state because the movable housing 704 is folded externally to the base housing 702. In general, the CETS 700 is similar to that shown in FIGS. 6A, 6B, 6C, and 6D, except that the movable housing 704 is detachably connected to the base housing 702 via the first attachment element 714 and may be removed from the base housing 702 as shown in FIG. 7A. The movable housing 704 may then be inverted as shown in FIG. 7B and inserted into the base housing 702 into a folded collapsed state (i.e., a "collapsed state" or a "telescoped state").

Figure 7B:
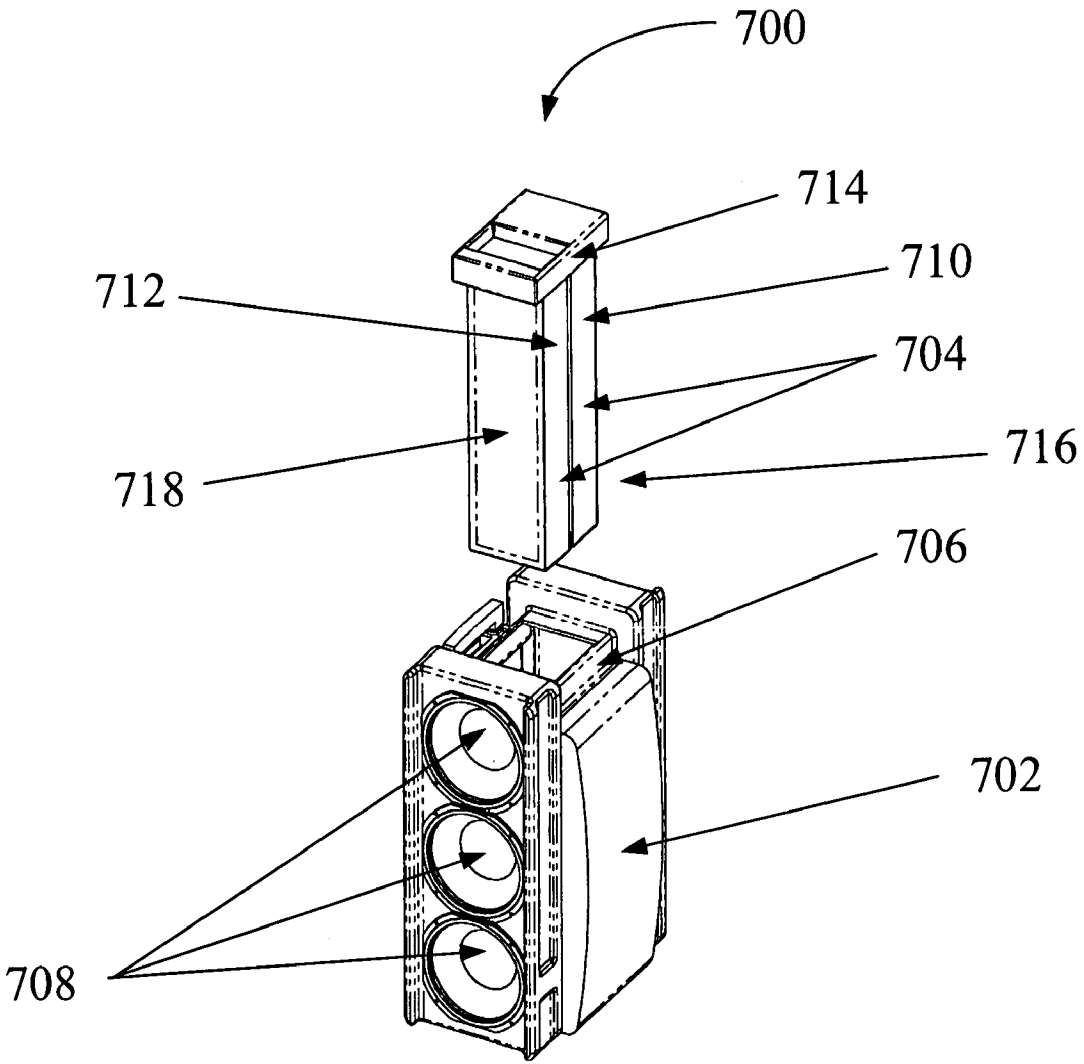
FIG. 7B is another perspective front-view of the example of the implementation of the CETS shown in FIG. 7A in a folded extended state where the movable housing is ready to insert into the base housing.
Figure 7C:
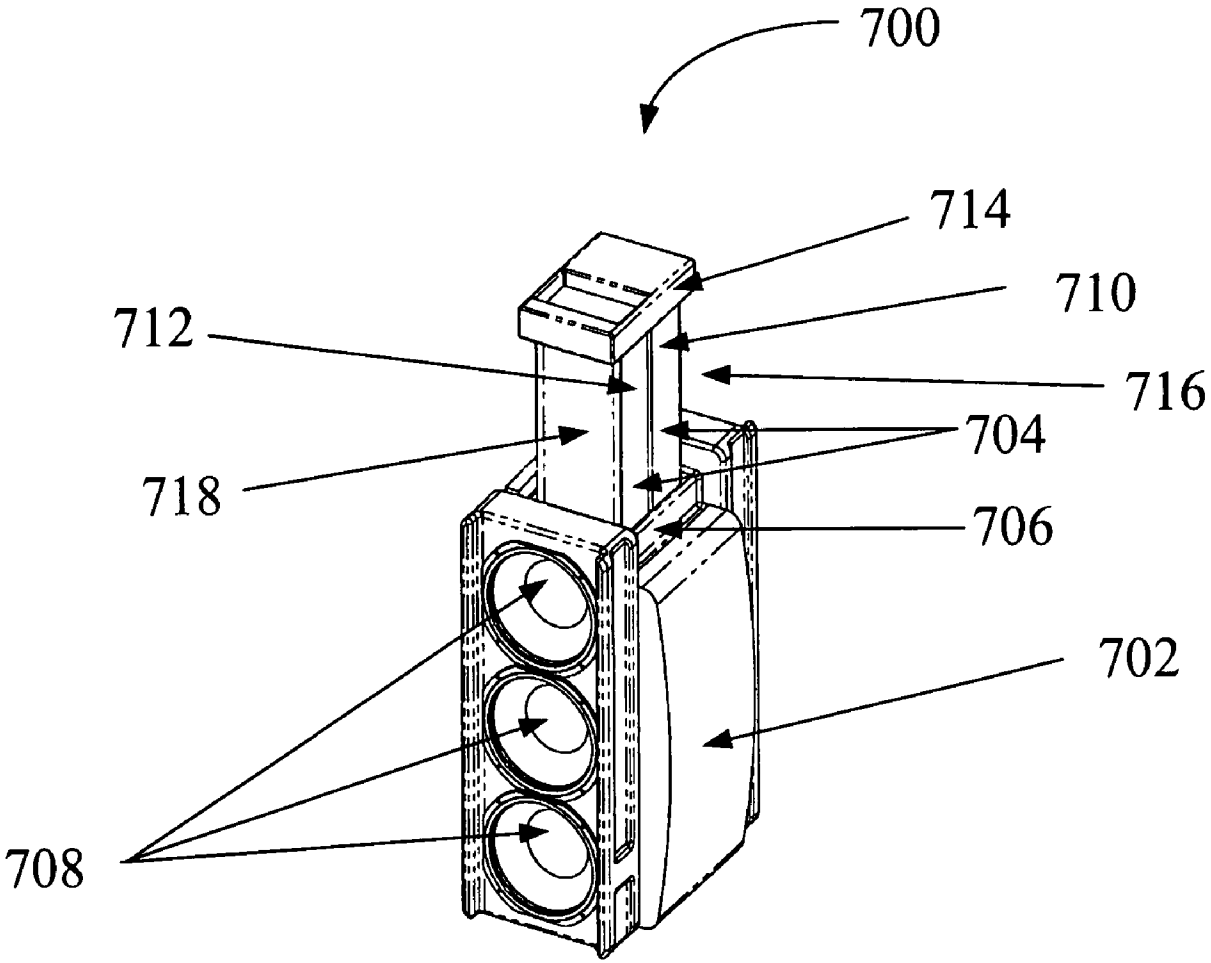
FIG. 7C is a perspective front-view of the example of the implementation of the CETS shown in FIGS. 7A and 7B in a partially collapsed state in accordance with the present invention.
Figure 7D:
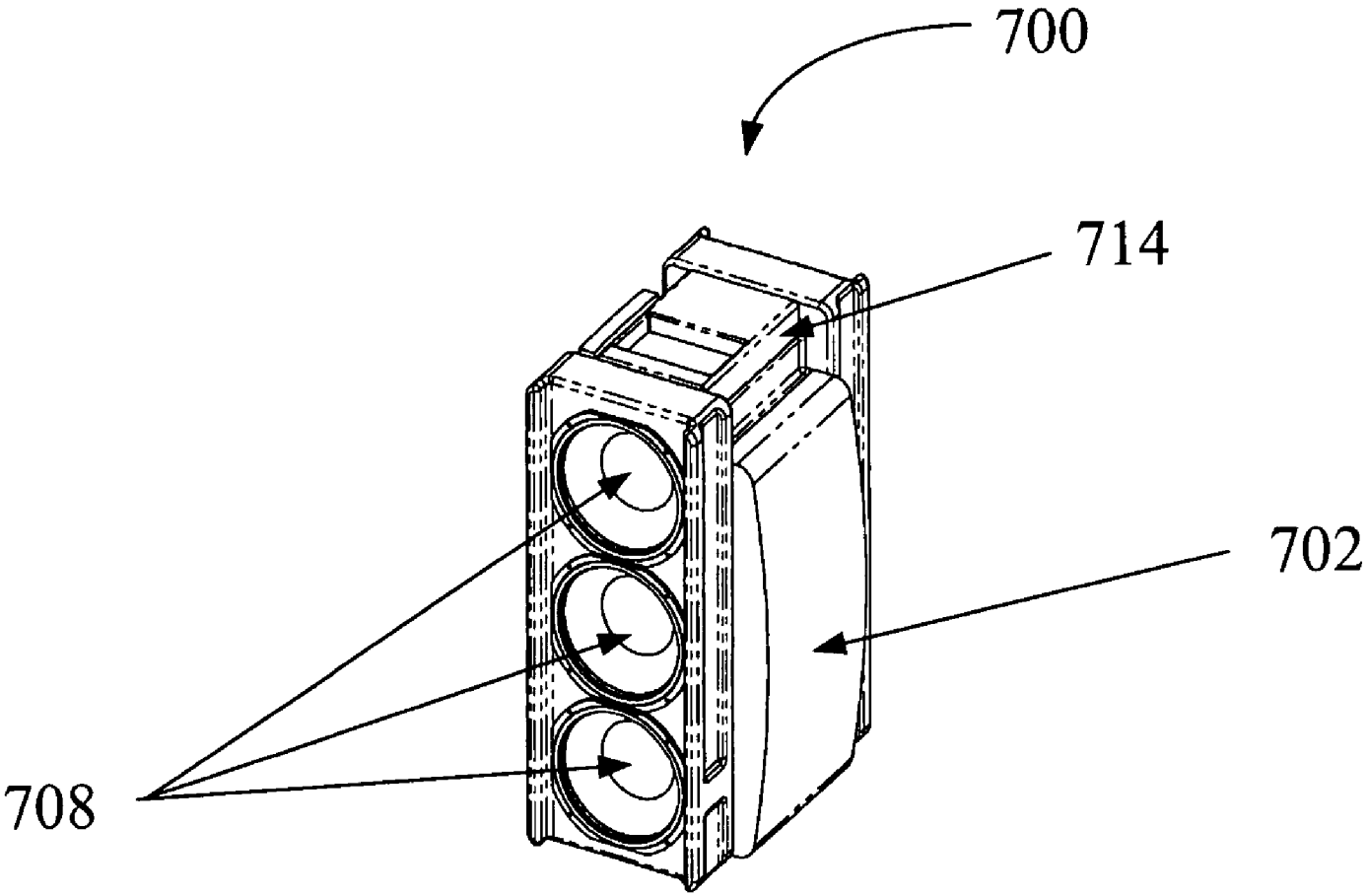
FIG. 7D is a perspective front-view of the example of the implementation of the CETS shown in FIGS. 7A, 7B, and 7C in a fully collapsed state in accordance with the present invention.
Figure 7E:
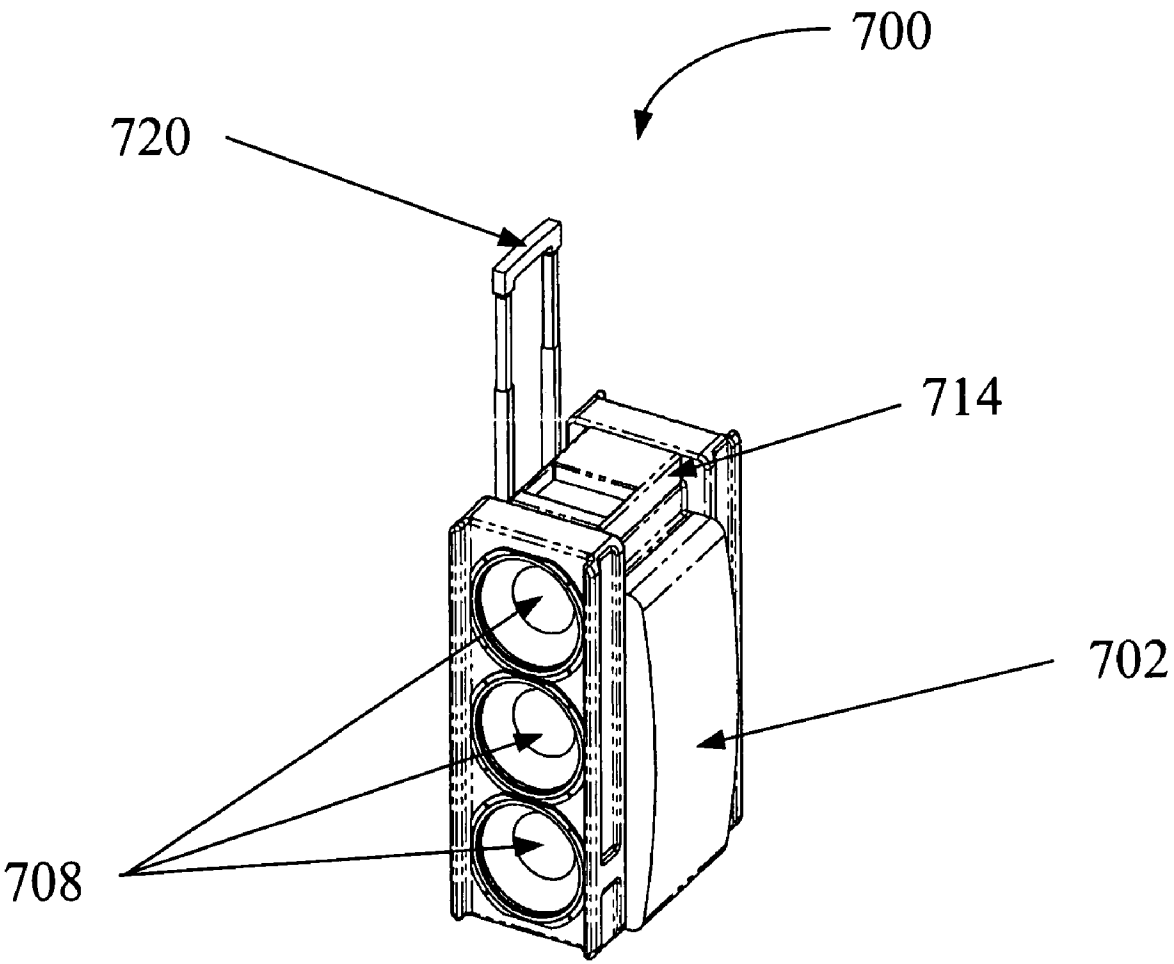
FIG. 7E is a perspective front-view of the example of the implementation of the CETS shown in FIGS. 7A, 7B, 7C, and 7D in a movable state in accordance with the present invention.

In FIG. 7C, a perspective front-view of the example of the implementation of the CETS 700 in FIGS. 7A and 7B is shown in a folded partially collapsed state (also known as a "folded extended state"). In this example, the CETS 700 is in a folded partially collapsed state because the movable housing 704 is folded partially external to the base housing 702. In FIG. 7D, a perspective front-view of the example of the implementation of the CETS 700 in FIGS. 7A, 7B, and 7C is shown in a fully collapsed state in accordance with the present invention. In FIG. 7D, the folded movable housing 704 is fully inserted within the base housing 702. In FIG. 7E, a perspective front-view of the example of the implementation of the CETS 700 in FIGS. 7A, 7B, 7C, and 7D is shown in a movable state in accordance with the present invention. In the example, the CETS 700 may have a handle 720 for transportation of the CETS 700. The handle 720 may also collapse within the base housing 702.

Figure 8A:
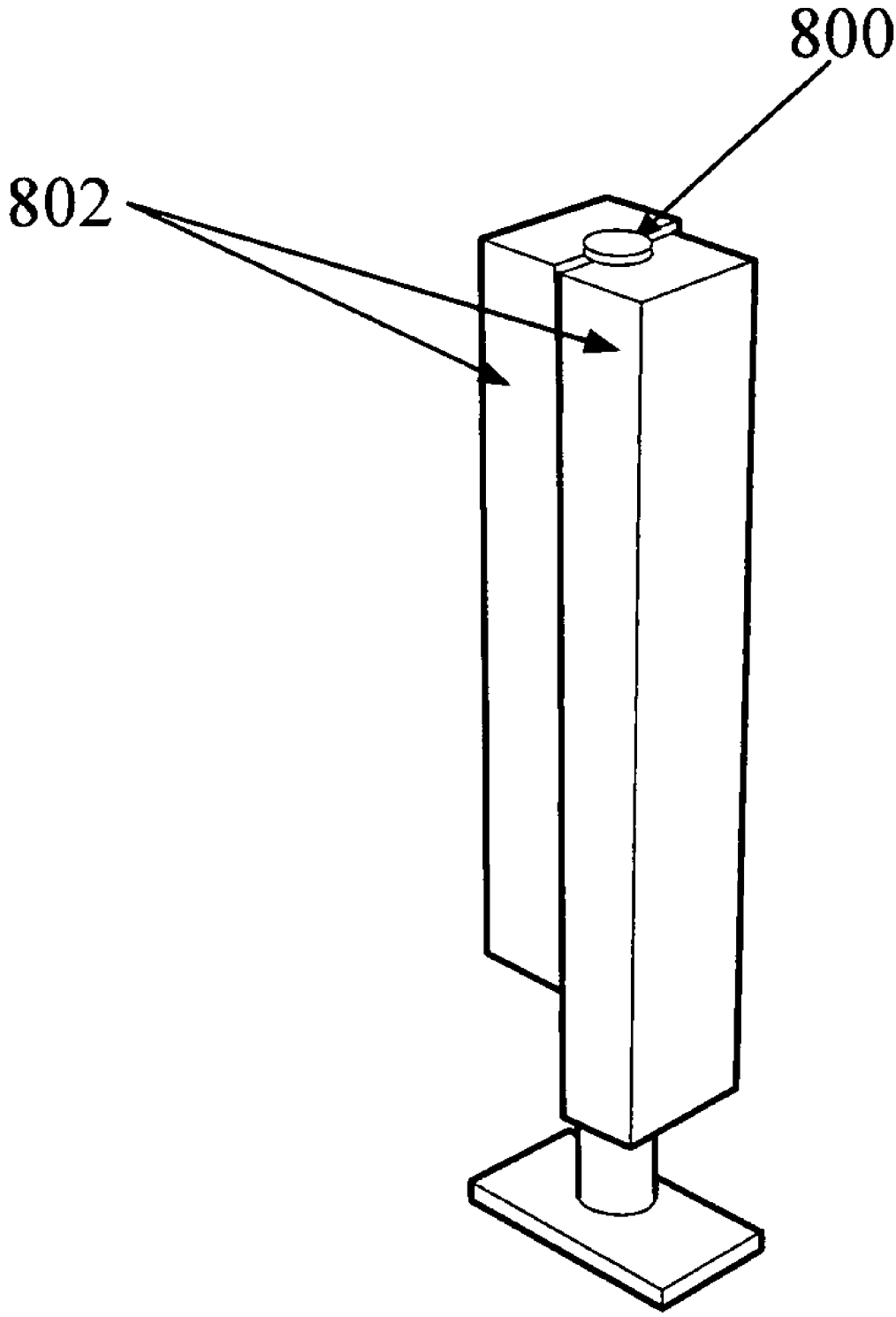
FIG. 8A is a front-prospective view of an example of another implementation of a second attaching element within the movable housing in accordance with the present invention.
Figure 8B:
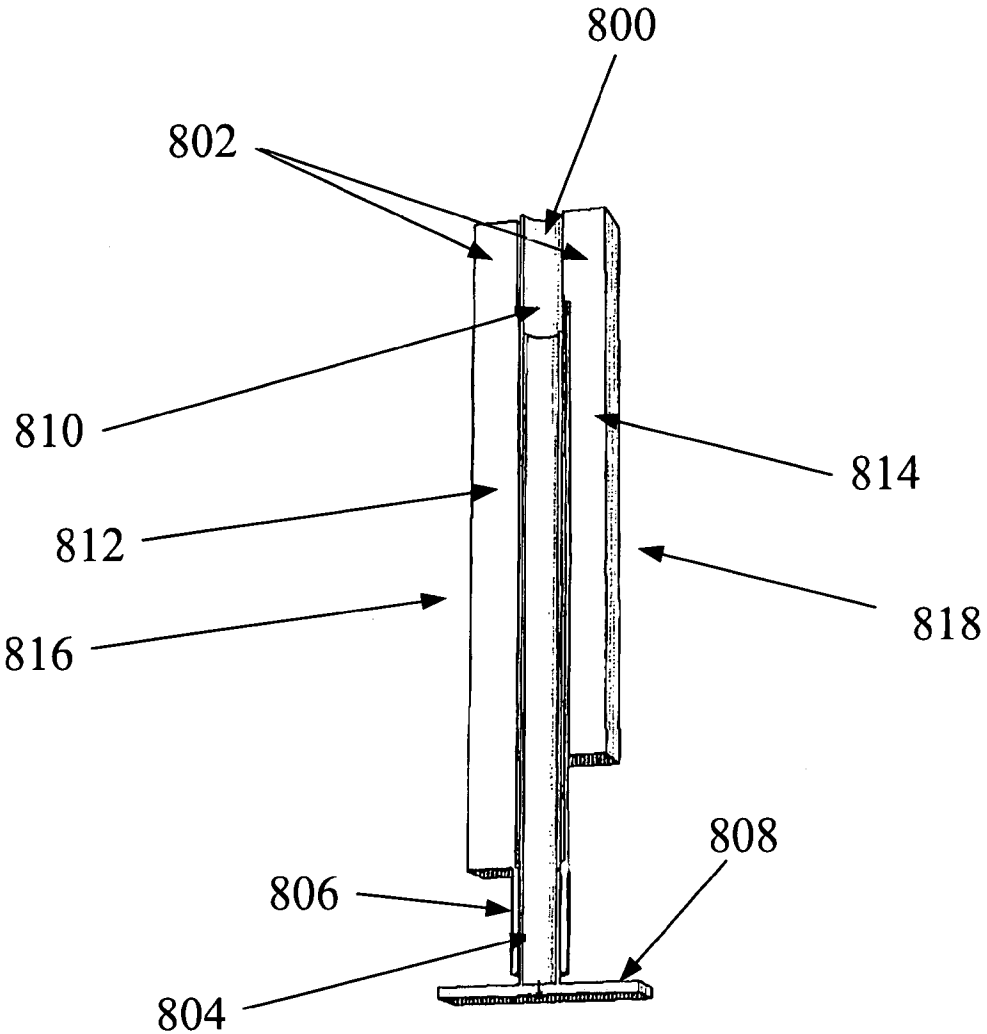
FIG. 8B is a cross-sectional side-view of the example of the implementation of the attaching element shown in FIG. 8A.

In FIG. 8A, a front-perspective view 800 of an example of another implementation of a second attaching element 800 within the movable housing 802 is shown in accordance with the present invention. Similarly, in FIG. 8B, a cross-sectional side-view of the example implementation of the second attaching element 800 within the movable housing 802 is shown. The second attaching element 800 may include an inner telescoping tube 804 and an external telescoping tube 806 connecting the movable housing 800 to the base housing (not shown) through the base plate 808 and a first attaching element (not shown). The second attaching element 800 may also include a telescoping rotating locking system 810 to lock the inner telescoping tube 804 and the external telescoping tube 806 into place when the movable housing 802 is either in a fully extended state or a folded state. As an example, in FIG. 8B, the movable housing 802 is shown in a folded state.

In this example implementation, the movable housing 802 rests on the base plate 808. The vertical inner telescoping tube 804 is attached to the base plate 808. The external telescoping tube 806 is capable of fitting around the vertical inner telescoping tube 804 which is attached to the rear of the movable housing 802. The movable housing 802 may include a first array element 812 and a second array element 814 attached by the second attaching element 800. The first array element 812 and second array element 814 may include a first plurality of transducers 816 and a second plurality of transducers 818, respectively. In the collapsed stored position, both the first array element 812 and the second array element 814 rest on the base plate 808.

To deploy the first array element 812 and second array element 814, the base plate 808 is raised by means of slider rails (not shown), or another similar first attachment element, to top of the base housing (not shown). The second array element 814 is then raised relative to the first array element 812 by means of sliding the external telescoping tube 806 over the vertical inner telescoping tube 804. Upon reaching the end of the vertical inner telescoping tube 804, the second array element 814 is rotated to rest on top of the first array element 812 by the telescoping rotating locking system 810.

Figure 9:
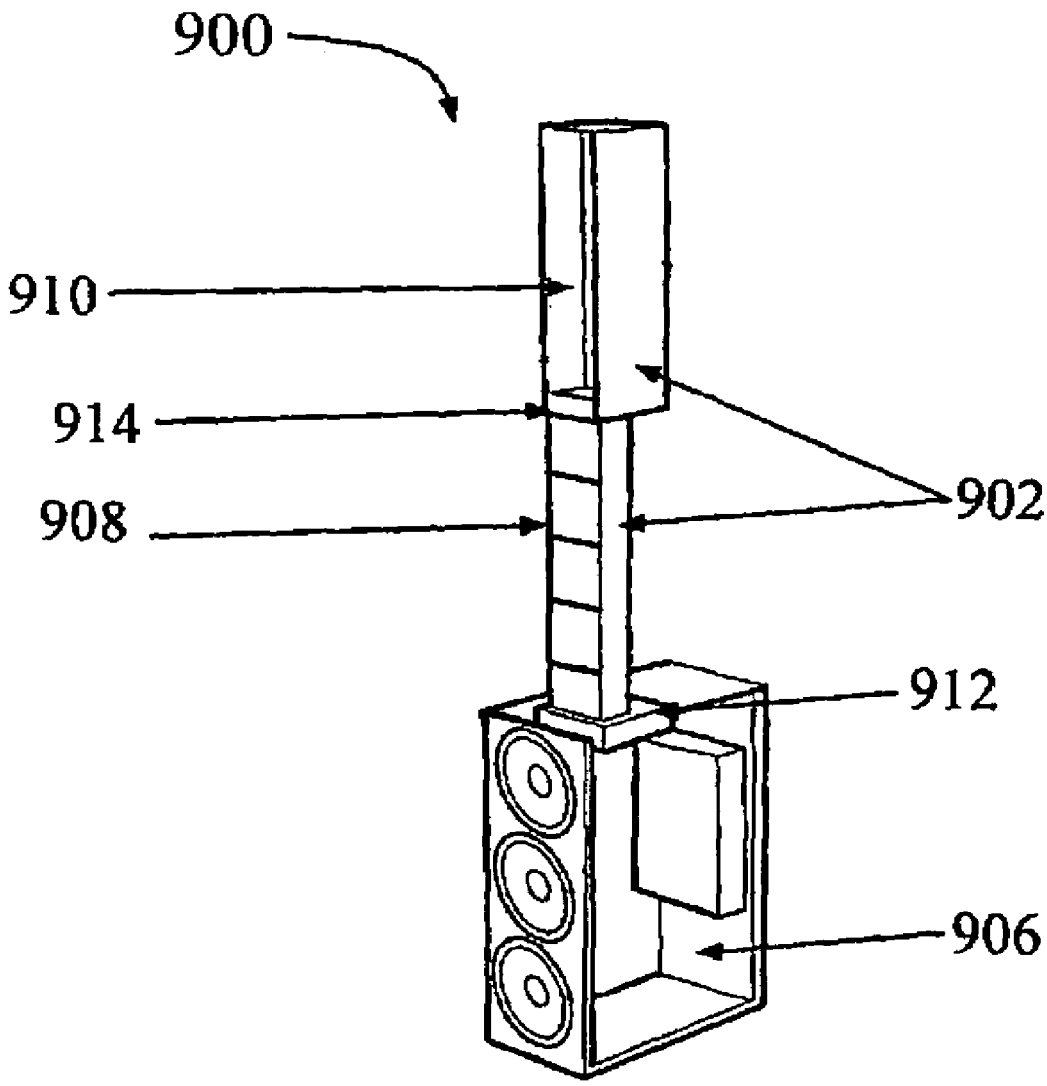
FIG. 9 is a perspective front-view of an example of yet another implementation of an attaching element within the movable housing in accordance with the present invention.

In FIG. 9, a perspective front-view of an example of yet another implementation of a second attachment element 914 within the movable housing 902 in the CETS 900 is shown in accordance with the present invention. The CETS 900 may include the movable housing 902 and a base housing 906 and the movable housing 902 may include a first array element 908 and a second array element 910. The CETS 900 may also include a first attaching element 912 connecting the movable housing 902 to the base housing 906. The first attachment element 912 may be a combination of slider rails (not shown) for guiding the movable housing 902 into the base housing 906 similar to the first attachment element shown in FIGS. 6A through 6D, or the first attachment element 912 may be detachable as shown in FIGS. 7A through 7E.

The second attachment element 914 connects the first array element 908 and the second array element 910. The second attachment element 914 may be a combination of a frame and slider rails (not shown) for guiding the second array element 910 up along the back of the first array element 908 and sliding the second array element 910 horizontally from behind to on top of the first array element 908.

Figure 10:
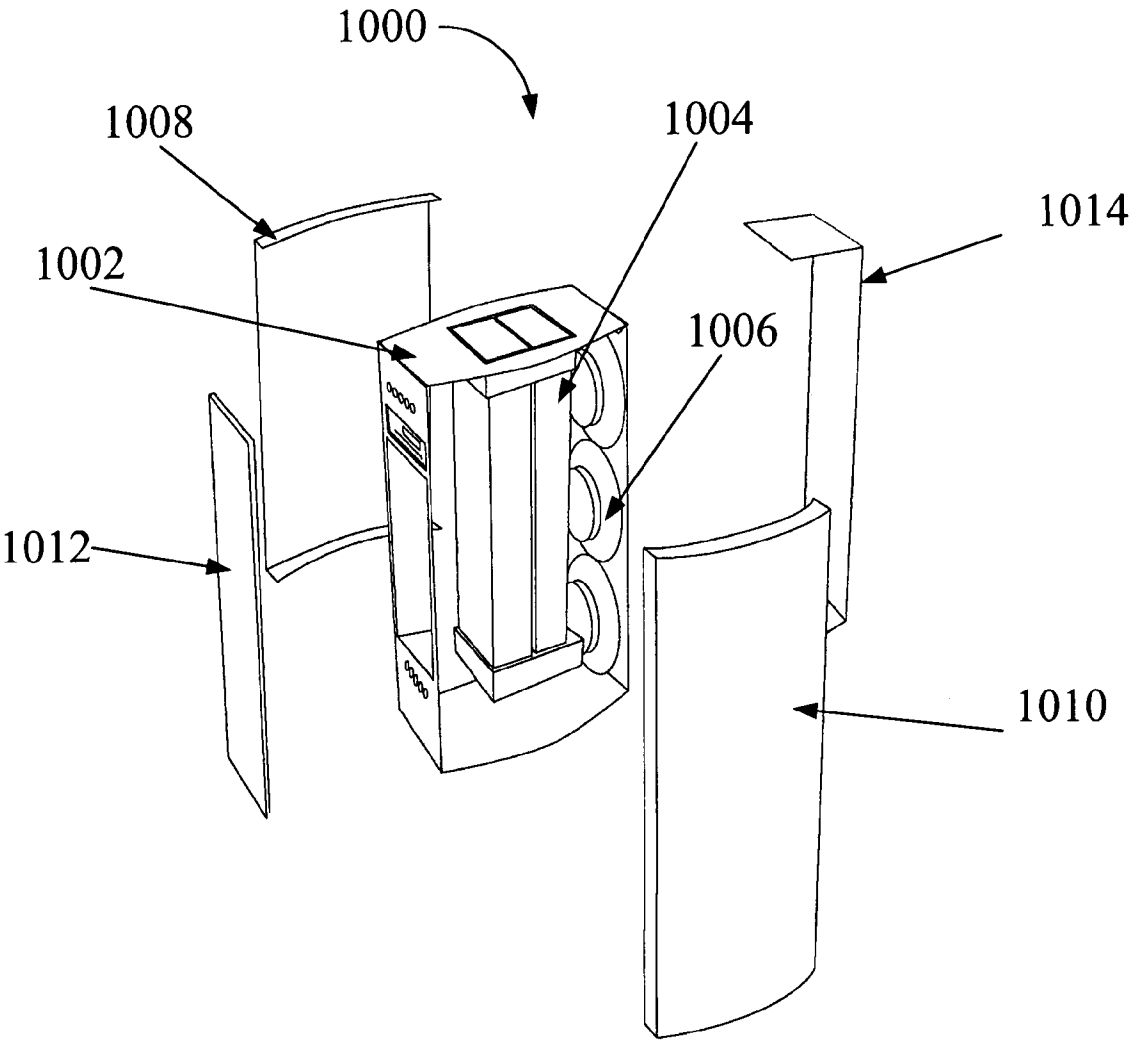
FIG. 10 is an exploded perspective rear-view of the CETS shown in FIGS. 1A and 1B.

FIG. 10 is an exploded perspective rear-view of an example of an implementation of the CETS 1000. The CETS 1000 may include a base housing 1002, a movable housing 1004, a plurality of transducers 1006 within the base housing 1002, an external housing having a plurality of external housing panels 1008, 1010, and 1012, and a transducer cover 1014. The plurality of external housing panels 1008, 1010, and 1012, base housing 1002, and movable housing 1004 may be constructed of various materials, e.g., wood, stainless steel, injection molded polypropylene or ABS, or formed composite/sheet material, based on considerations of weight, durability, aesthetics, etc. The transducer cover 1014 may be constructed of felt, plastic, perforated metal, metal meshing, etc.

While various embodiments of the invention have been described, it will be apparent to those of ordinary skill in the art that many more embodiments and implementations are possible that are within the scope of this invention.

What is claimed is:

1. A collapsible electro-acoustic transducer system ("CETS"), the CETS system comprising:

a base housing with at least one base housing electro-acoustic transducer, wherein the base housing includes a base housing top and a base housing bottom;

a movable housing having a first array element and a second array element;

a first attachment element movably attaching the movable housing to the base housing, wherein the first attaching element is configured to collapse the movable housing within the base housing; and a second attachment element movably attaching the first array element and the second array element.

2. The CETS of claim 1, wherein the base housing includes:

a plurality of base housing electro-acoustic transducers; and a storage area capable of storing at least one peripheral device.

3. The CETS of claim 2, further including an external housing attached externally to the base housing.

4. The CETS of claim 3, wherein the external housing includes a pair of side walls, a front wall and a back wall, and a bottom wall and a top wall.

5. The CETS of claim 1, wherein the movable housing further includes;

a plurality of movable housing electro-acoustic transducers having at least one first array element electro-acoustic transducer and at least one second array element electro-acoustic transducer.

6. The CETS of claim 5, wherein the first attachment element includes sliding elements that are configured to enable the movable housing to slide within the base housing to create a collapsed state.

7. The CETS of claim 6, wherein the movable housing further includes a first array base plate connected to the first array element.

8. The CETS of claim 6, wherein the second attachment element is a hinge element that is configured to fold the second array element from an extended position to a folded position, wherein the extended position includes the second array element positioned above the first array element and wherein the folded position includes the second array element positioned adjacent to the first array element.

9. The CETS of claim 8, wherein the hinge element folds the second array element such that the at least one first array element electro-acoustic transducer and the at least one second array element electro-acoustic transducer are positioned adjacently.

10. The CETS of claim 8, wherein the hinge element folds the second array element such that the at least one first array element electro-acoustic transducer and the at least one second array element electro-acoustic transducer are not positioned adjacently.

11. The CETS of claim 6, wherein the second attachment element is a rotating element that is configured to rotate and slide the second array element from an extended position to a folded position, wherein the extended position includes the second array element positioned above the first array element and wherein the folded position includes the second array element positioned adjacent to the first array element.

12. The CETS of claim 6, wherein the second attachment element is a sliding element that is configured to slide the second array element from an extended position to a folded position, wherein the extended position includes the second array element positioned above the first array element and wherein the folded position includes the second array element positioned adjacent to the first array element.

13. The CETS of claim 5, wherein the first attachment element is configured to detach the movable housing, wherein the detached movable housing is inserted within the base housing.

14. The CETS of claim 13, wherein the movable housing further includes a first array base plate connected to the first array element.

15. The CETS of claim 13, wherein the second attachment element is a hinge element that is configured to fold the second array element from an extended position to a folded position, wherein the extended position includes the second array element positioned above the first array element and wherein the folded position includes the second array element positioned adjacent to the first array element.

16. The CETS of claim 15, wherein the hinge element folds the second array element such that the at least one first array element electro-acoustic transducer and the at least one second array element electro-acoustic transducer are positioned adjacently.

17. The CETS of claim 15, wherein the hinge element folds the second array element such that the at least one first array element electro-acoustic transducer and the at least one second array element electro-acoustic transducer are not positioned adjacently.

18. The CETS of claim 13, wherein the second attachment element is a rotating element that is configured to rotate and slide the second array element from an extended position to a folded position, wherein the extended position includes the second array element positioned above the first array element and wherein the folded position includes the second array element positioned adjacent to the first array element.

19. The CETS of claim 13, wherein the second attachment element is a sliding element that is configured to slide the second array element from an extended position to a folded position, wherein the extended position includes the second array element positioned above the first array element and wherein the folded position includes the second array element positioned adjacent to the first array element.

20. A method for utilizing a collapsible electro-acoustic transducer system ("CETS"), method comprising:

extending a movable housing from a base housing, the movable housing having at least one movable housing electro-acoustic transducer and the base housing having at least one base housing electro-acoustic transducer, wherein the base housing and movable housing are attached by a first attachment element; and unfolding the movable housing, wherein the movable housing includes a first array element and a second array element attached by a second attachment element.

21. The method of claim 20, wherein the movable housing further includes a plurality of movable housing electro-acoustic transducers having at least one first array element electro-acoustic transducer and at least one second array element electro-acoustic transducer.

* * * * *